United States Patent [19]

Soto

[11] 4,014,276

[45] Mar. 29, 1977

[54] MACHINE FOR PROCESSING DRAPERY MATERIAL

[76] Inventor: Enrique Soto, 1638 W. Washington Blvd., Los Angeles, Calif. 90007

[22] Filed: Jan. 6, 1975

[21] Appl. No.: 538,788

Related U.S. Application Data

[63] Continuation-in-part of Ser. No. 390,332, Aug. 22, 1973, Pat. No. 3,884,747.

[52] U.S. Cl. ..... 112/214

[51] Int. Cl.[2] ..... D05B 27/10

[58] Field of Search ..... 112/214, 211, 203, 121.29, 112/121.27, 121.15, 121.12; 156/461

[56] References Cited

UNITED STATES PATENTS

| | | | |
|---|---|---|---|
| 2,529,859 | 11/1950 | Ambler et al. | 156/460 |
| 3,068,137 | 12/1962 | Seubert | 156/290 |
| 3,076,638 | 4/1965 | Goppert | 112/214 X |
| 3,163,139 | 12/1964 | Hedegaard | 112/214 X |
| 3,204,590 | 9/1965 | Rockerath et al. | 112/214 X |
| 3,425,377 | 2/1969 | Scharmer | 112/214 X |
| 3,795,565 | 3/1974 | Soto | 156/465 |

*Primary Examiner*—H. Hampton Hunter
*Attorney, Agent, or Firm*—Herzig & Walsh, Inc.

[57] ABSTRACT

A measured length of drapery material is carried through the machine and through a processing appliance at one end of the machine. The machine has a tabling surface with a moving portion provided by a rotary drum which moves the fabric. The material passing through the machine comprises several widths seamed together. At the end of the machine, a strip of stiffening material is aligned with the edge of the material which will be the top edge of the drape and the materials are then stitched together by a sewing machine, the excess material being continuously cut off by a cutter.

5 Claims, 6 Drawing Figures

161
137
111
263
257
160
250
294
259
165
248
295
30
118
236
249
262
32
190
128
242
164
212
210
80
100
156
181
216
169
20
180
168
102
172
192
155
152
170
173
12
140

136
137
134
142
139
138

273
270
249
250
191
262
301
300
256
258
128
190
260
30
5
170
212
236
63
242
100
246
12
32
4
5
222
216
210
172
224
223
218
95
214
156
192
290
184
155
182
183
186
14
194
196
304
200
153
310
152
154
307
306

MACHINE FOR PROCESSING DRAPERY MATERIAL

This application is a continuation-in-part of Ser. No. 390,332, filed Aug. 22, 1973, now U.S. Pat. No. 3,884,747.

FIELD OF THE INVENTION

The field is that of tabling and processing fabric material, particularly drapery material, especially in the area of applying stiffening means to an edge part of the material.

BACKGROUND OF THE INVENTION

The machine is an improvement in the processing of drapery material with a greatly reduced amount of hand labor and space requirements which have been characteristic of the prior art up to date.

The prior art is best exemplified in this inventors U.S. Pat. Nos. 3,795,565 and 3,884,747, which are hereby incorporated herein by reference.

Known other prior art includes U.S. Pat. Nos. 1,507,342; 2,501,873; 2,529,859; 2,937,689; 3,012,603; 3,044,534; 3,058,634; 3,068,137; 3,012,603; 3,102,305; 3,143,456, 3,184,798; 3,463,482; 3,534,954; 3,654,015; 3,631,826; 2,737,750; and 3,795,565.

SUMMARY OF THE INVENTION

The invention is a machine for processing fabric material, particularly drapery material from which drapes are made. Basically, the machine provides a relatively wide tabling surface over which the material is passed and on which it is held down by pressure rollers. The tabling surface embodies a rotary drum providing a moving surface for transporting, i.e., tumbling the fabric. The machine is provided at one end of said surface with mechanism for processing the edge of a drapery material which is the edge which becomes the top of the finished drape. This mechanism is a power driven sewing machine which stitches a strip of stiffening material, preferably buckram to the drapery material.

A primary object is to realize simplified but extremely effective and easy to use apparatus for applying the stiffening material.

Another object is to simplify and make possible the continuous processing of the top of the drape, including applying of the stiffening material, simply by means of a power driven sewing machine.

Another object is to speed up the processing of the drapery material using simplified apparatus while at the same time reducing the number of personnel required and the amount of space required.

BRIEF DESCRIPTION OF THE DRAWINGS

Further objects and additional advantages of the invention will become apparent from the following detailed description and annexed drawings, wherein.

DESCRIPTION OF THE PREFERRED EMBODIMENT

Figures 1, 4, 5:
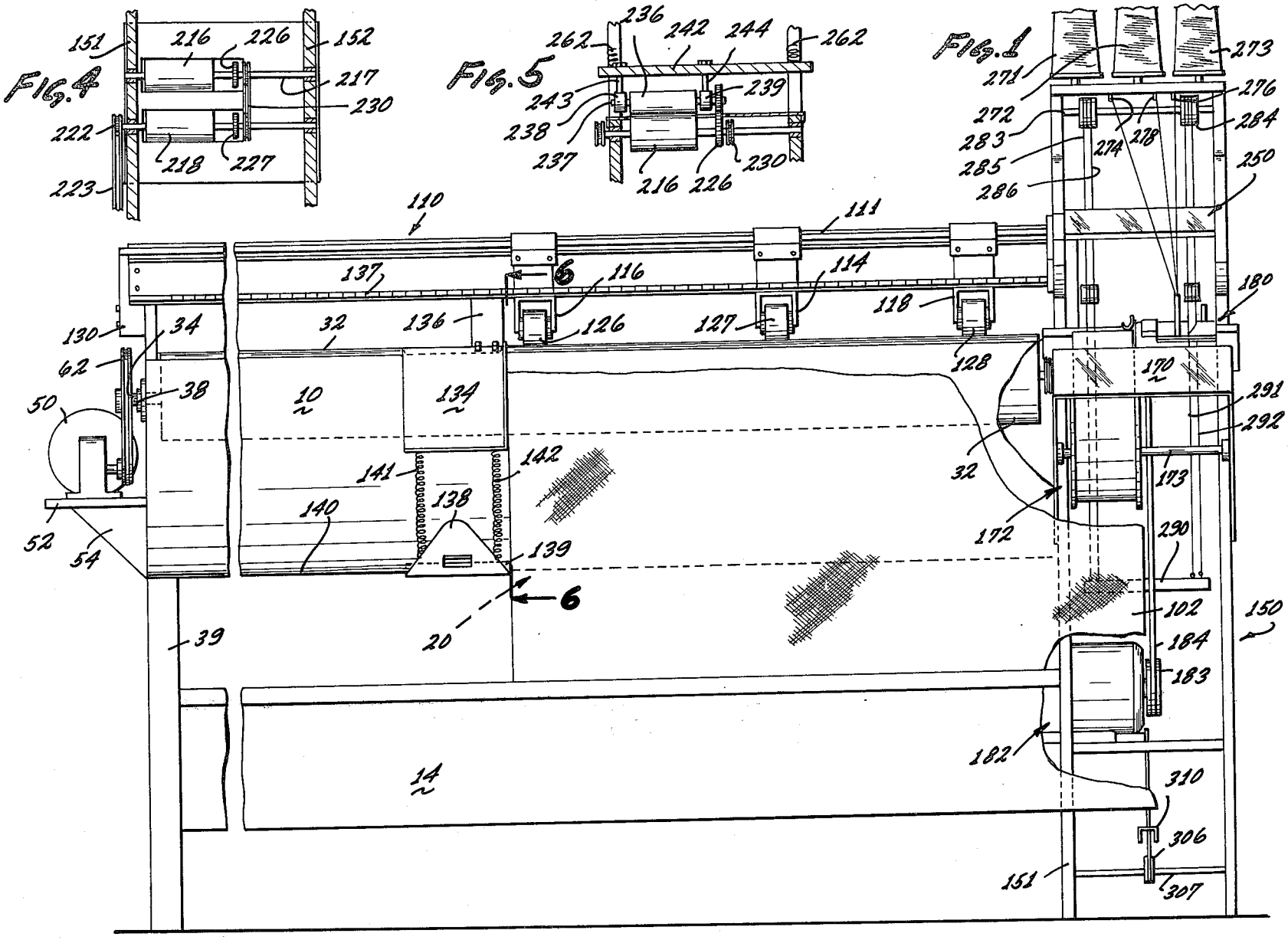
FIG. 1 is a front elevational view of the machine of the invention.
FIG. 4 is a sectional view taken along the line 4—4 of FIG. 3.
FIG. 5 is a sectional view taken along the line 5—5 of FIG. 3.
Figure 2:
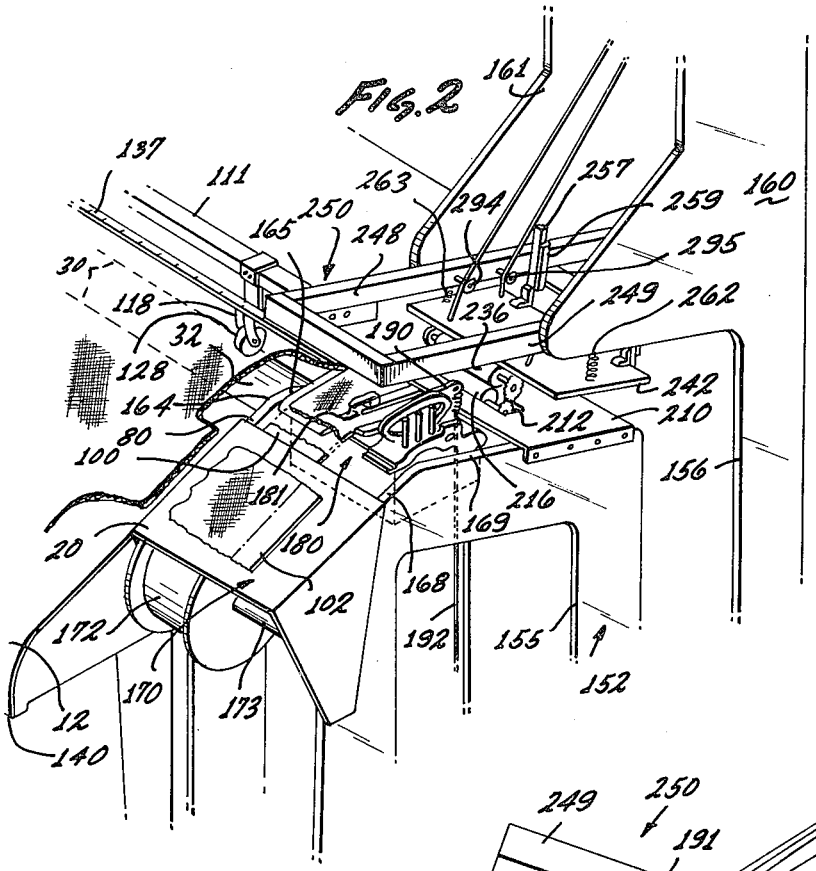
FIG. 2 is a partial isometric view of the end of the machine at which the stiffener is applied.
Figure 3:
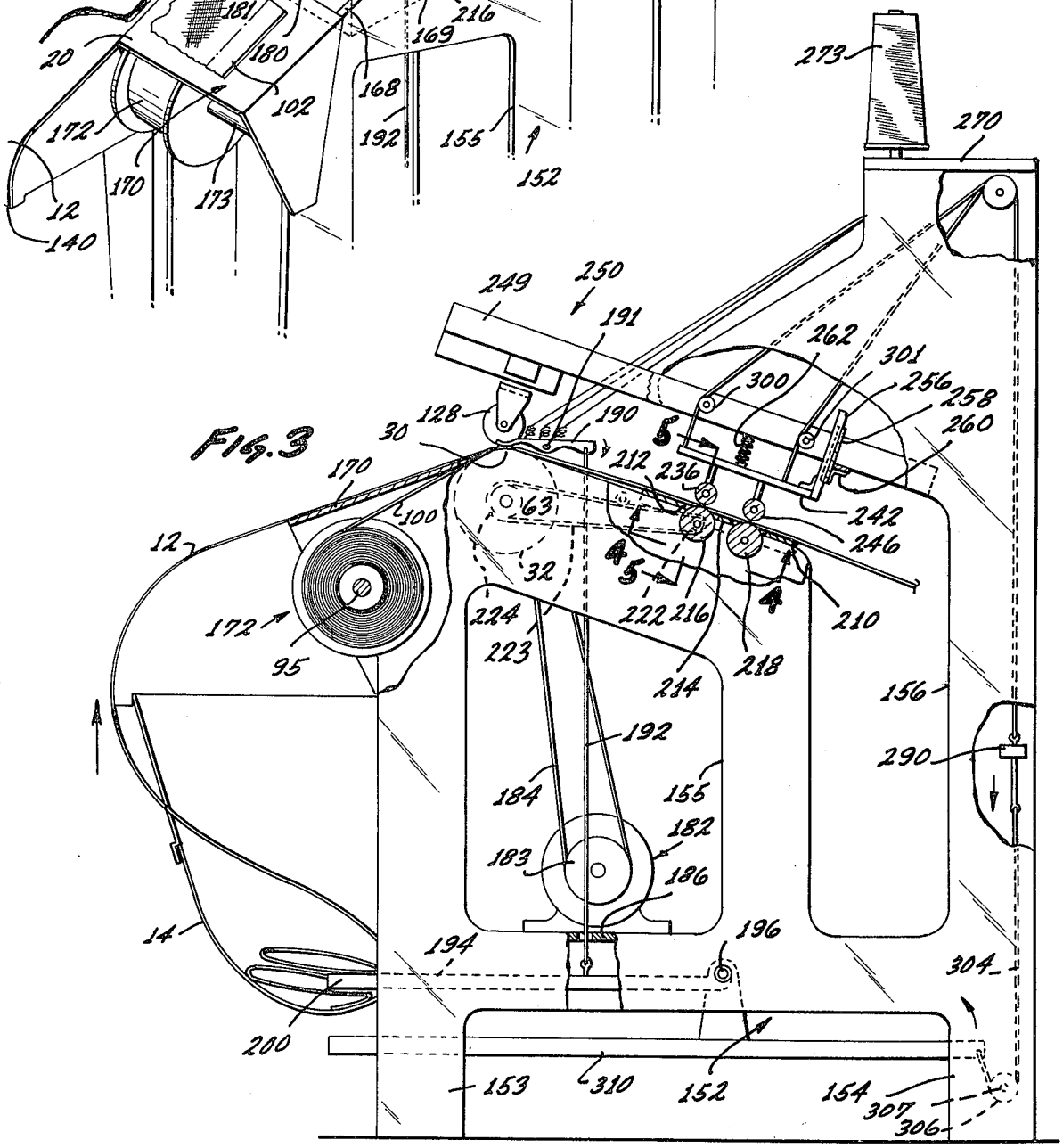
FIG. 3 is an end view of the machine.

The general organization fo the machine will best be appreciated from FIGS. 1, 2 and 3, FIG. 1 being a front view of the machine, FIG. 3 being an end view and FIG. 2 being a partial isometric view. The operator occupies a position at the front of the machine for applying the edge or border stiffener at the right end of the machine as seen in FIG. 1. In operation, as will be explained presently, the drapery fabric is tumbled, that is, passed or carried from one basket or fabric holder over the platform or table and the rotating drum into another basket or holder on the other side of the tabling surface. The table or platform surface over which the fabric passes is designated by numeral 10. Fabric passes over the tabling surface from left to right as seen in FIGS. 2 and 3. The drapery material is designated at 12 and moves from a holder or basket 14 on the entrance side to a holder or backet on the other side.

Basket 14 is made from fabric material, the edges or ends of which are suspended underneath the frame structure of the machine by suspension members. The rear basket is of similar construction and is similarly suspended.

On the entering side, the tabling surface includes an inclined part 20. This surface may be formed of any suitable material which can be formed into the desired contour, such as plastic or otherwise. On the other side of the tabling surface beyond the processing mechanism is an inclined surface 26 which may be formed of any suitable material. There is a gap 30 shown in FIG. 2, between inclined surfaces 20 and 26.

Numeral 32 designates an elongated cylindrical drum mounted on shaft 34, the drum being in a position such that its upper part extends into gap 30. As may be seen, drapery fabric 12 leads up over the contoured inlet surface, over the upper part of rotating drum 32, and on to inclined surface at the back of the machine. It will be understood that by reason of the contact between the periphery of drum 32 and fabric 12, the drapery material will be continually moved or caused to traverse (tumbled) from left to right as will be described more in detail presently. Rotating drum 32 is exemplary of a preferred means for moving the drapery material, that is to cause it to traverse the tabling surface, although other alternative means may be employed.

Shaft 34 is journalled in bearing 38 and in a similar bearing at the other end as may be seen in FIG. 1. A supporting frame structure is provided underneath the tabling structure which is supported by four supporting legs, one of them being shown at 39.

Drum 32 is driven by motor 50 suitably supported on platform 52 supported by way of bracket structure 54. Motor 50 drives a shaft 56 which drives shaft 34 of drum 32 by way of sprocket wheels and sprocket chain 62. Shaft 34 is journalled at the opposite end of the machine. It extends beyond housing 40 and carries sprocket wheel 63 which will be referred to again presently.

The drapery material is accurately measured and formed (sized) and guided as it is passed (tumbled) over the tabling surface. It is held down during its passage. The sizing and guiding mechanism is best shown in FIG. 1. Supported over the tabling surface and substantially over drum 32 is an assembly designated generally at 110 including rail 111. Carried by rail 111 of the assembly 110 are rollers 126, 127 and 128 which may be made of rubber or composition material. These rollers are journalled on suitable shafts carried by rider members 116, 117 and 118. Member 110 is supported from the frame of the machine including bracket 130 at one end, the riders 116–118 can slide along rail 111.

Figure 6:
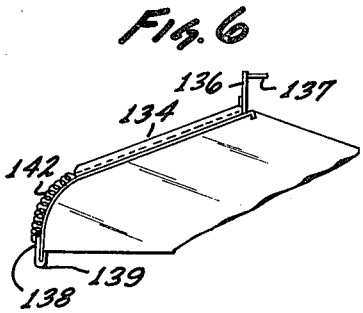
FIG. 6 is a partial sectional view taken along the line 6—6 of FIG. 1.

The tabling surface 10 comprises a smooth surface material which may be metal or plastic or comparable material. Numeral 134 designates a metal bracket plate having a flange at the upper edge which hooks over the upper edge of the table surface adjacent to the gap 30 in it. Numeral 136 designates a small plate which is hinged to the plate 134 as shown, which provides a guide stop at the left end of the fabric material the edge of this plate being adjacent to graduated scale 137. Numeral 138 designates another bracket plate having a flange 139 which clips over the lower edge 140 of the tabling surface. Plates 134 and 138 are urged together by tension springs 141 and 142, thereby making it easy to adjust these plates along the tabling surface, the stop and measuring plate 136 being adjusted at the same time. The details of this structure are shown in FIG. 6.

The mechanism at the right end of the machine for applying the strip of stiffening material is best shown in FIGS. 1, 2 and 3, FIGS. 4 and 5 being sectional detail views. At the right end of the machine there is a stand as designated generally by the numeral 150, having side members 151 and 152. The side member 152 has a configuration as shown in FIG. 3 having legs 153 and 154 and having openings 155 and 156. The side members have upper parts 160 and 161 which include forwardly extending portions as shown in FIG. 2. The side member 151 has inclined slanted upper surface 164 and downwardly slanted surface 165. The side member 152 has a similar slanted upper surface 168 and an upper surface 169. Between the surface parts 165 and 168 is a platform 170. Beneath this platform is the roll 172 of stiffening material that is, the buckram being on a shaft 173 as shown. As may be seen in the figures, the strip of a buckram comes off the roll underneath the platform 170, as will be described. The edge part of the fabric material is over the platform 170 as may be seen in FIG. 2 so that it overlies the strip of stiffening material. Mounted between the side members 151 and 152 is a sewing machine 180 which is of a commercial type preferably being a three-spool overlock type or it may be any type that produces an overlock type of stitch. It has sewing foot 181 and foot plate 179. Beyond the foot, there is a cutting mechanism that cuts off extra material. The machine is driven by a motor 182 having a pulley 183 and driving belt 184 that drives the machine. The motor 182 is supported on a platform 186 between the side members 151 and 152. Numeral 190 designates a control lever for the sewing machine which is pivoted as shown at 191 and which may be actuated by a control cable 192 connected to a control lever 194 pivoted on a pivot 196 between the side members 151 and 152. The lever has an end foot pedal 200 which may be actuated by the operator's foot.

Numeral 210 designates a platform mounted transversely on the surfaces 165 and 169 of the side members and over which the fabric material passes after the stiffening strip has been sewn to it. This surface has rectangular openings as designated at 212 and 214. Numerals 216 and 218 designate rollers on shafts 217 and 219, the ends of which are journalled in the side members 151 and 152. See FIG. 4. On the shaft 219 is a sprocket wheel 222 driven by a sprocket chain 223 which passes over sprocket wheel 224 on the shaft 34. On the shafts 217 and 219 are sprocket wheels 226 and 227 and passing over these sprocket wheels is a sprocket chain 230 so that both of these rollers are driven.

Directly overlying the roller 216 is a roller 236 on a shaft 237 journalled in journal bearings 238 and 239 extended from a platform 242 by stems 243 and 244. See FIG. 5. Similarly supported from the platform 242 is a further roller 246 which directly overlies the roller 218 as may be seen in FIG. 3.

Numeral 250 designates a rectangular frame having side members and end members as shown, the side members being supported between the upper portions 160 and 161 of the side members 152 and 151. At the rear of the platform member 242 there are upright members secured thereto as designated at 256 and 257 which cooperate with guide slides 258 and 259 positioned perpendicularly to the frame 250 and held by brackets as designated at 260 in FIG. 3. Springs are provided as shown at 262 and 263 between platform 242 and the side members of frame 250.

As explained, the platform 242 supports the rollers 236 and 246 which can be moved in a direction normal to the surface of platform 210, that is away from the edge part of the fabric material.

Numeral 270 designates a transverse member mounted on top of the upperparts of the side members 151 and 152. Supported on the member 270 are three spindles supporting conical thread spools 271, 272 and 273. Threads from these spools extend through guide members 274, 275 and 276 down to the three spool overlap sewing machine 180 as may be seen in FIGS. 1 and 3.

Numeral 282 designates a transverse shaft underneath the platform 270 having on it two double pulleys 283 and 284. Passing over pulley 283 are two cords 285 and 286 which attach to a transverse block 290 and passing over the pulley 284 are two other cords or cables 291 and 292 which attach to the other end of the block 290. The two cords passing over pulley 283 then pass over pulleys 294 and 295 on side member 248 of frame 250 and then are attached to the platform 242 as may be seen in FIG. 2. The two cords passing over pulley 284 pass over similar pulleys 200 and 301 carried by side member 249 of frame 250 as may be seen in FIG. 3 and are secured to the other end of platform 242.

Block 290 is attached by a cable 304 which passes over a pulley 306 on a shaft 307 extending between wide members 151 and 152 and attaches to the end of lever member 310, the end of which extends forwardly to a position between side members 151 and 152 where it may be actuated by the operator's foot. When the end of the lever is pushed down, it tensions the cable 304 thus exerting a pull on all of the cables 285, 286, 291 and 292, so that the platform 242 is moved towards the frame 250 against the springs like the one designated 262 so that the rollers 236 and 246 are moved away from the rollers 216 and 218. This movement of the rollers allows initial positioning of the fabric or threading it through for the beginning of an operation. During operation both the lower rollers are being driven to assist in causing the fabric with the stiffening material sewn to it to travel through the machine.

The excess fabric material beyond the stitched line is is cut off by a driven cutter disc positioned to operate beyond the sewing machine.

OPERATION

From the foregoing, those skilled in the art will readily understand the nature of the operation of the machine and the effectiveness and simplicity with which it accomplishes its intended purpose.

The motors 50 and 182 are energized for operation. The fabric material is tabled on the tabling surface with the left edge positioned against the member 136 for the correct width as indicated on the scale. The right edge overlies the platform 170 over the stiffening material as described with the edge of the material and the stiffening material then passing the motor driven sewing machine which makes the seam along the edge of the materials. The edge of the fabric with the stiffening material attached passes over the platform 210 between the tangent rollers which serve to guide the edge and to assist in causing it to traverse through the machine. The upper tangent rollers are readily lifted away for positioning the edge of the materials initially merely by actuation of the lever 310. Operation of the sewing machine is initiated simply by actuation of the lever 200, the three threads automatically coming off the spools. Thus, it is to be seen that the operation is very simple but effective.

The foregoing disclosure is representative of a preferred form of the invention and is to be interpreted in an illustrative rather than a limiting sense, the invention to be accorded the full scope of the claims appended hereto.

What is claimed is:

1. A machine for tabling and processing fabric material, the said machine having means providing a surface constructed to have a relatively wide strip of fabric material pass through it from the front to the back of the machine, means for causing the material to pass through the machine over the said surface, means for processing an edge part of the fabric material at one side of the machine, said processing means including a source of a strip of stiffening material positioned for juxtaposing the stiffening material against an edge part of the fabric material and moving it with the fabric material, said processing means including a power driven sewing machine positioned to stitch an edge part of the fabric material to the strip of stiffening material, tangent roller means having axis positioned normally to the direction of movement of the fabric material and to have the edge part of the fabric material and attached stiffener material pass between them, and manually actuable means for moving one of said tangent rollers away from the other whereby to allow threading of the fabric material and stiffener strip between them.

2. An apparatus as in claim 1, wherein said processing means includes platform surfaces over which the edge part of the fabric material passes, there being a space between the platform surfaces, said sewing machine being positioned in said space whereby to stitch the edge part of the fabric material to the stiffener strip.

3. An apparatus as in claim 1 including means for driving at least one of said tangent rollers about its axis.

4. An apparatus as in claim 2, wherein one of said platform surfaces has opening means in it, one of said rollers being positioned to extend partly into said opening means.

5. A machine for tabling and processing fabric material, the said machine being constructed to have a relatively wide strip of fabric material pass through it from the front to the back of the machine, means for causing the material to pass through the machine, means for processing an edge part of the fabric material at one side of the machine, said processing means including a source of a strip of stiffening material positioned for juxtaposing the stiffening material against an edge part of the fabric material, said processing means including a power driven sewing machine positioned to stitch an edge part of the fabric material to the strip of stiffening material, tangent roller means having axes positioned normally to the direction of movement of the fabric material and to have the edge part of the fabric material and attached stiffener material pass between them, said tangent roller means including two pairs of tangent rollers, one roller of each tangent pair being positioned to be below the fabric material and a roller of said pair being positioned to be above the fabric material, support means carrying the rollers that are above the fabric material, guide means of said supporting means whereby the support means can be moved in a direction towards and away from the fabric material and manually attached means for moving said support means away from the fabric material.

* * * * *